United States Patent [19]

Sparks et al.

[11] Patent Number: 4,786,120

[45] Date of Patent: Nov. 22, 1988

[54] KEYBOARD ENCLOSURE ASSEMBLY

[75] Inventors: Jeffrey L. Sparks; Mark S. Ferguson; William C. Duke, all of Durham, N.C.

[73] Assignee: Casica Corporation, Durham, N.C.

[21] Appl. No.: 108,378

[22] Filed: Oct. 14, 1987

[51] Int. Cl.[4] ..... A47B 21/00

[52] U.S. Cl. ..... 312/208; 312/284

[58] Field of Search ..... 312/208, 292, 284; 400/713, 714

[56] References Cited

U.S. PATENT DOCUMENTS

| | | | |
|---|---|---|---|
| 3,480,728 | 11/1969 | Chandler | 400/713 X |
| 3,566,816 | 3/1971 | Zilg | 312/208 X |
| 3,667,648 | 6/1972 | Koziol | 312/292 X |
| 3,887,057 | 6/1973 | Stahl et al. | 312/208 X |
| 4,671,688 | 6/1982 | Brashears | 400/714 |

FOREIGN PATENT DOCUMENTS

| | | | |
|---|---|---|---|
| 1957318 | 5/1971 | Fed. Rep. of Germany | 312/208 |

*Primary Examiner*—Joseph Falk

*Attorney, Agent, or Firm*—Steven J. Hultquist

[57] ABSTRACT

An enclosure assembly for a keyboard, which is of compact configuration and provides protection for the keyboard during periods of non-use thereof. The keyboard enclosure assembly comprises a base member which is reposable on the keyboard to cover at least some of the marginal areas and peripheral surfaces thereof, and a cover member having on its bottom surfaces recess(es) positioned and configured to receive and closely overfit keys of the keyboard to retain the cover member in a substantially spatially fixed position, the cover member being cooperatively matable with the base member, so that the cover member and base member together enclose the keyboard over its top and peripheral surfaces. The enclosure assembly may be fabricated of any of a wide variety of materials to provide an aesthetic enhancement to the environment in which the keyboard is employed.

6 Claims, 4 Drawing Sheets

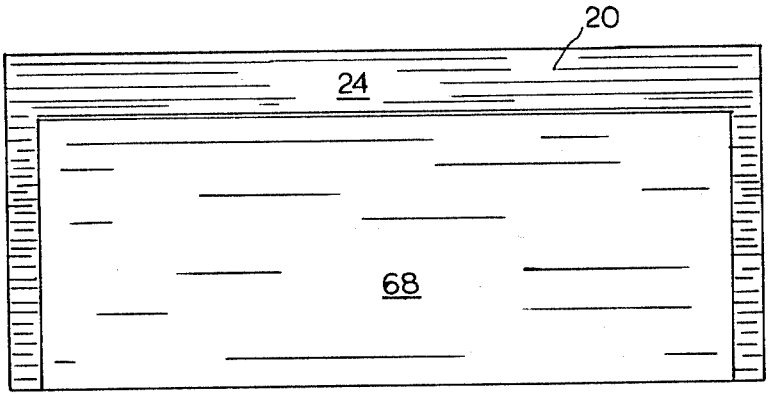
FIG. 2
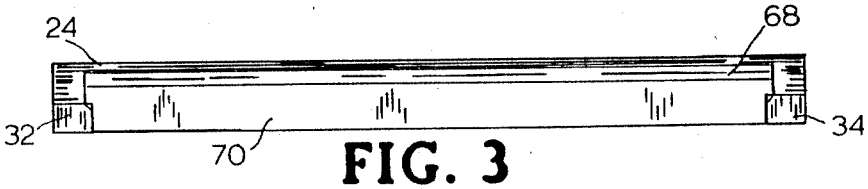
FIG. 3
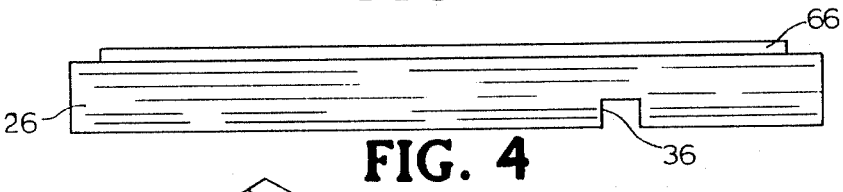
FIG. 4
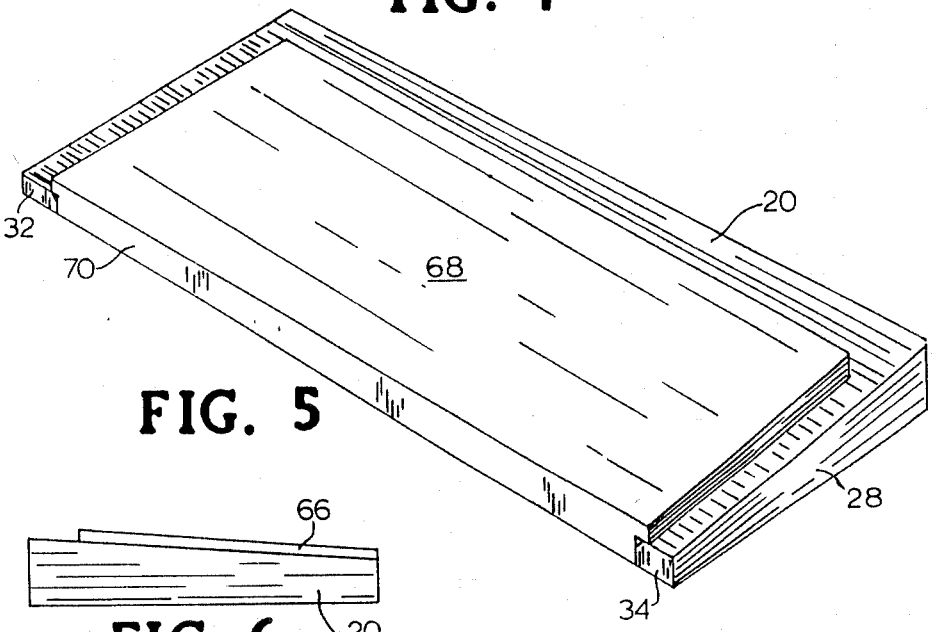
FIG. 5
FIG. 6

KEYBOARD ENCLOSURE ASSEMBLY

BACKGROUND OF THE INVENTION

This invention relates generally to decorative, protective, and/or storage enclosures for keyboard elements such as are utilized in conjunction with personal computers, dedicated word processors, electronic workstations, and remote control systems for video cassette recorders (VCRs), broadcast and cable television (CATV) systems, and the like.

Description of the Related Art

With the increasing proliferation of personal computers in homes and offices, an entire industry has developed which is devoted to manufacturing and commercializing computer tables, desks, shelf units, and other computer-related furniture items.

For aesthetic reasons, and in order to provide and maintain a clean and efficient workspace, shelf units and cabinets of various configurations have been developed, for storage and use of computer system components such as disk drives, monitors, modems, mice, keyboards, and printers, in unitary structures.

An example of a personal computer storage-type furniture module is the PC Cube II TM cabinet unit, commercially available from Global® Computer Supplies (Plainview, N.Y.) in which the monitor, central processing unit (CPU), keyboard, and printer elements of a personal computer system are contained in a module of four square feet volume. The respective PC printer, keyboard, and CPU components in this assembly are positioned on sliding platforms for ease of accessibility to the user, with the keyboard being situated on a sliding platform which is pulled out at table level toward the user, and with the monitor being positioned on top of the unit. The distributor offers as an adjunct to the PC Cube II TM unit a locking monitor cover which fits on top of the PC Cube II TM unit as an additional component module thereof.

The foregoing product represents one of many approaches to storing the component parts of the personal computer system in a shelf or enclosure unit, whereby the personal computer system is integrated into a furniture-type cabinet or module.

With specific reference to the keyboard component of the personal computer system, the previously existing designs either retain the keyboard in a cabinet of significantly larger volume than the keyboard itself, so that space is wasted, or else deploy the keyboard on a shelf or base which leaves it exposed to environmental conditions, including atmospheric moisture and dust particles, as well as susceptible to liquid spills, e.g., from beverage cups and glasses placed in proximity to the keyboard during periods between active use. In addition, in such configurations, the keyboard is susceptible to being damaged by impact.

Clear plastic housing covers have been commercialized to overlie the keyboard between periods of use, as a protective enhancement therefor. Such covers typically comprise a main rectangularly-shaped flat plate portion having walls extending downwardly from each of its four sides, thereby forming an open-bottomed box. While performing the desired protective function, this cover is somewhat lacking in aesthetic appeal, particularly when the computer system is reposed on a desk, table, or shelf of fine wood or other rich-appearing surface, and takes up a significant spatial volume, as compared to the keyboard per se.

Accordingly, it is an object of the present invention to provide a keyboard enclosure assembly which provides protection for the keyboard during periods of non-use thereof, and which may be fabricated in a wide variety of materials to provide an aesthetic acoutrement to the environment in which the keyboard is employed.

It is a further object of the invention to provide a keyboard enclosure assembly of the foregoing type, which is highly compact in character, thus minimizing the space requirements for the enclosed keyboard.

Other objects and advantages of the invention will be more fully apparent from the ensuing disclosure and appended claims.

SUMMARY OF THE INVENTION

The present invention in one aspect relates to an enclosure assembly for a keyboard comprising an array of keys, the enclosure assembly comprising:

(a) base member reposable on the keyboard to cover selected marginal portions and peripheral surfaces thereof; and (b) a cover member having on its bottom surface recess(es) positioned and configured to receive and closely overfit at least some of the keys in the array of keys, to retain the cover member in a substantially spatially fixed position, with the cover member and the base member together enclosing the keyboard over its main top surface and peripheral side surfaces.

In another aspect, the present invention relates to an enclosure assembly for a keyboard of generally rectangular shape with a main top surface comprising an array of keys including selected raised keys of greater height than the other keys in said array, the enclosure assembly comprising:

(a) a U-shaped member having a channel along the full length of its inner surface which is adapted to receive and enclose said keyboard along rear and side margins thereof; and (b) a cover member having on its bottom surface recess(es) positioned and configured to receive and closely overfit the selected raised keys to retain the cover member in a substantially spatially fixed position, the cover member being cooperatively matable with the U-shaped cover member, so that the cover member and U-shaped member together enclose the keyboard over its front, rear, side, and main top surfaces.

In still another aspect, the cover member may comprise a main top portion joined at its front edge to a flange portion downwardly depending therefrom, the main top portion having on its bottom surface recess(es) positioned and configured to receive and closely overfit the selected raised keys to retain the cover member in a substantially spatially fixed position on the main top surface of the keyboard, so that the cover member flange portion covers the keyboard along its front surface and the main top portion of the cover member covers the keyboard over its main top surface.

In a further aspect, the enclosure assembly comprising the base member and cover member may be formed of a material such as wood, plastic, metal, leather, and the like.

Other aspects and features of the invention will be more fully apparent from the ensuing disclosure and appended claims.

BRIEF DESCRIPTION OF THE DRAWINGS

FIG. 2 is a top plan view of the keyboard enclosure assembly shown in FIG. 1.

FIG. 3 is a front elevational view of the keyboard enclosure assembly of FIG. 1.

FIG. 4 is a rear elevational view of the keyboard enclosure assembly of FIG. 1.

FIG. 5 is a perspective view of the keyboard enclosure assembly of FIG. 1, with the cover member being cooperatively mated with the U-shaped member so that the cover member and U-shaped member together enclose the front, rear, side, and main top surfaces of the associated keyboard.

FIG. 6 is a side elevational view of the keyboard enclosure assembly of FIG. 5.

DETAILED DESCRIPTION OF THE INVENTION, AND PREFERRED EMBODIMENTS THEREOF

The keyboard assembly of the present invention represents a highly compact protective and storage unit for keyboards of various types. The enclosure assembly provides an aesthetic appearance and enhanced protection for the keyboard during periods when the keyboard is not actively being used.

While the ensuing enclosure will be directed primarly to keyboards of the type employed in conjunction with personal computer systems, it will be appreciated that the utility of the invention is not thus limited, and that the keyboard enclosure assembly of the invention may be used for keyboards of various other types, including, for example, remote control units for VCRs, stereo and video disk systems, radio, broadcast and CATV systems, and other appliances and systems controlled by remote control units having a keyboard for direct or remote control thereof; keyboards of word processors, electronic work stations, and the like; etc.

The keyboard enclosure assembly of the present invention may be fabricated in a wide variety of materials to provide the desired aesthetic appearance in the environment the keyboard is employed. Examples of suitable construction materials may include wood, metal, leather, plastics, wicker, composite materials, and the like. A preferred material of construction, particularly when the keyboard is reposed on a desk, table, or shelf of fine wood or other rich-appearing material, is wood, such as mahogany, cherry, walnut, or oak.

As indicated, the keyboard enclosure assembly of the present invention may usefully be employed for enclosure and storage of keyboards of the type employed with personal computer systems. Preferably, the keyboard enclosure assembly of the present invention when utilized in such application is employed in combination with monitor and/or central processing unit (CPU) enclosure cabinets of the type disclosed and claimed in our concurrently filed U.S. design patent applications entitled "COMPUTER MONITOR CABINET" Ser. No. 07/108,568, "COMPUTER CENTRAL PROCESSING UNIT CABINET" Ser. No. 07/108,567, and "COMPUTER MONITOR/CENTRAL PROCESSING UNIT CABINET" Ser. No. 07/108,362, filed Oct. 14, 1987, in our names.

Figure 1:
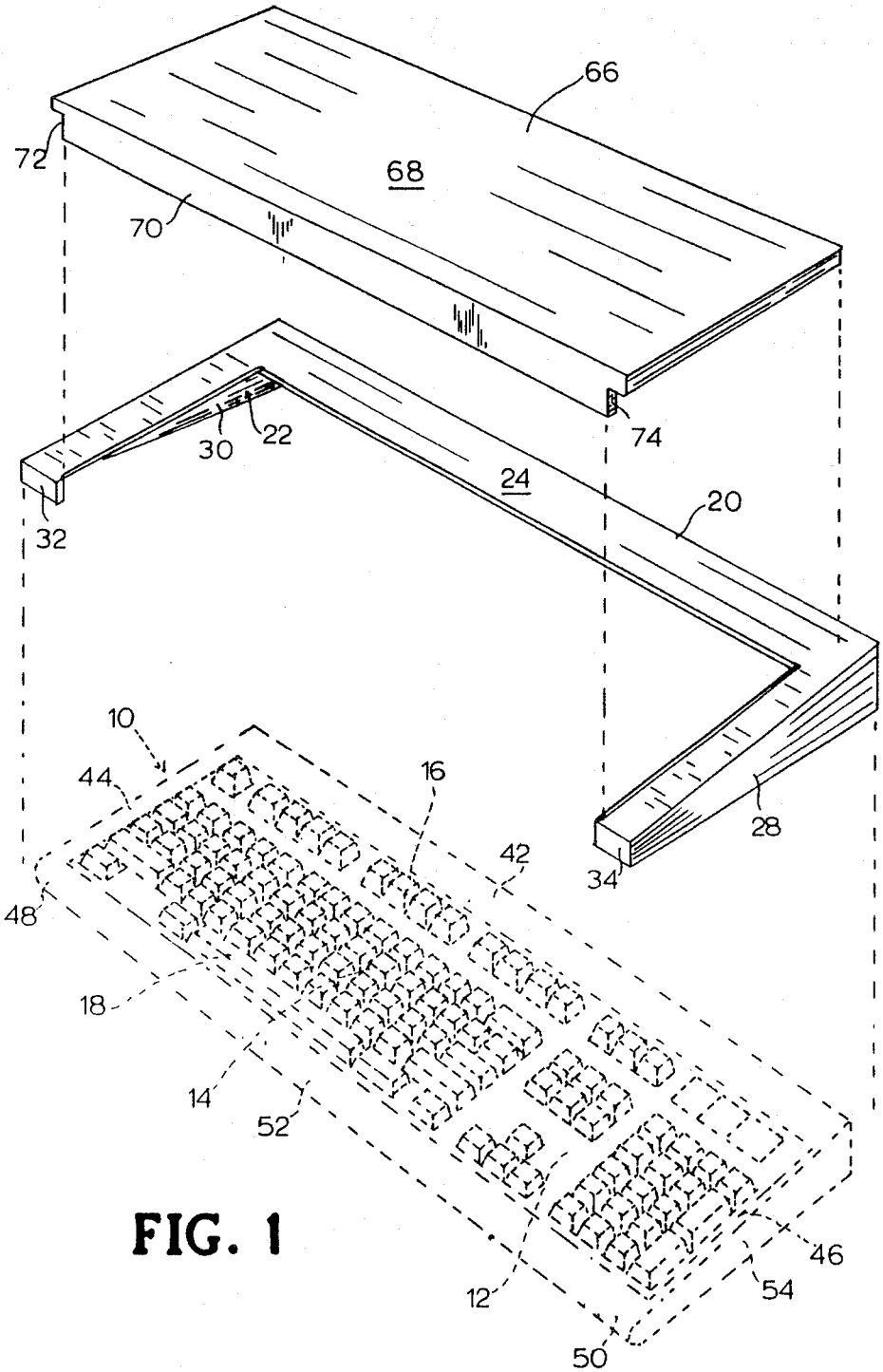
FIG. 1 is an exploded perspective view of the keyboard enclosure assembly according to the present invention, in one embodiment therof, as associated with a standard personal computer keyboard.
Figure 7:
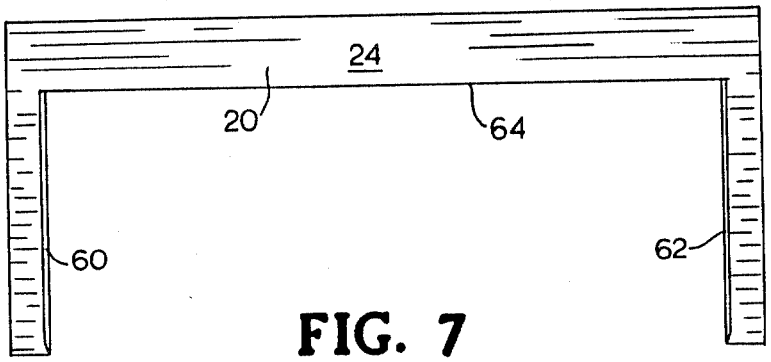
FIG. 7 is a top plan view of the U-shaped member of the keyboard enclosure assembly of FIG. 1.

Referring now to the drawings, FIG. 1 shows an exploded perspective view of the keyboard enclosure assembly of the invention with an associated keyboard. A corresponding drawing of the fully assembled enclosure unit is shown in FIG. 5, and corresponding top, front, rear, and side views are shown in FIGS. 2, 3, 4 and 6, respectively. The same reference numerals are used throughout in these drawings, as well as in FIGS. 7–10 showing various views of the U-shaped member of the enclosure, and FIGS. 11–15, showing various views of the cover member.

FIG. 1 shows a keyboard 10 of generally rectangular shape with a main top surface 12 comprising an array of keys 14 including selected raised keys 16 in the back row and raised keys 18 in the front row, which are of greater height than the other keys in the array.

Figure 15:
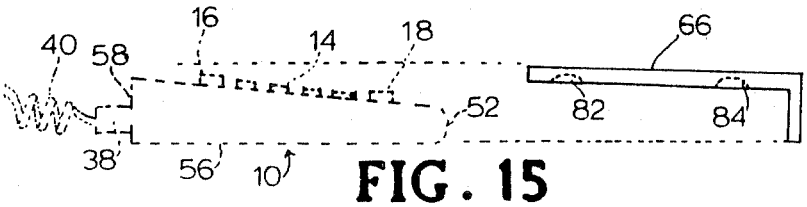
FIG. 15 is a side elevational view of the keyboard and cover member, showing their cooperatively positioned relationship.

This is more clearly shown in FIG. 15, wherein the keyboard 10 is shown in side elevation view, illustrating the spatial configuration of the key array 14 as comprising a back row 16 of raised keys and a front row 18 of raised keys, relative to the lower height intermediate rows.

In this drawing (FIG. 15), the side elevational view of the key array shows "dished" configuration of successive rows with the highest keys at the outside rows and the intermediate rows being of lesser height. Such raised key configuration is typical of personal computer keyboards, and is the result of biomechanical and ergonomic analysis indicating such configuration to be most advantageous from the standpoint of speed, efficiency, and minimizing manual strain in the keying operation.

The enclosure assembly comprises a first base member which partially encloses the keyboard, in combination with a second cover member which cooperatively mates with the partial enclosure member to cover the top, front, back and side surfaces of the keyboard. The cover member features recess(es) which are positioned and configured to receive and closely overfit keys on the keyboard, to retain the cover member in a substanially spatially fixed position.

Figure 8:
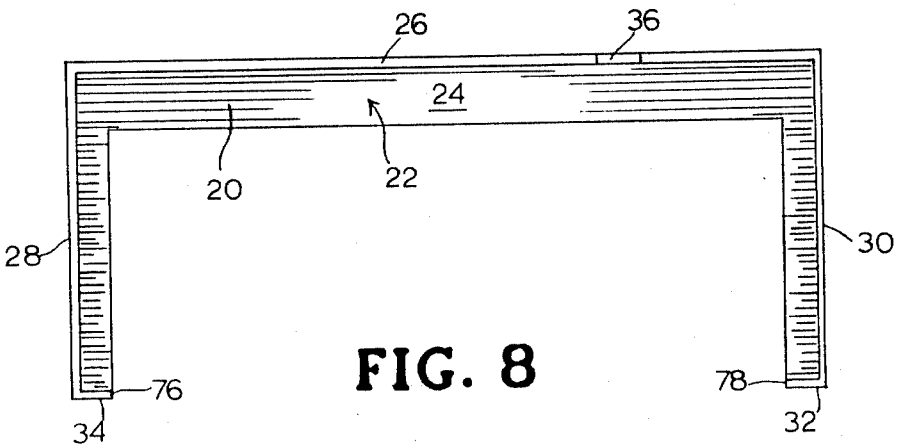
FIG. 8 is a bottom plan view of the U-shaped member of FIG. 7.
Figure 9:
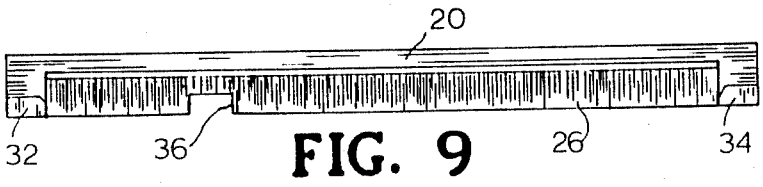
FIG. 9 is a front elevational view of the U-shaped member of FIG. 7.
Figure 10:
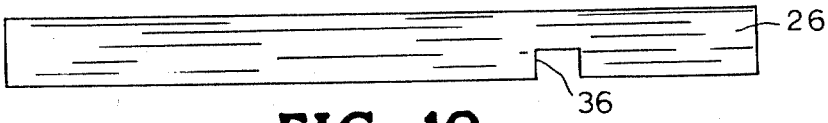
FIG. 10 is a rear elevational view of the U-shaped member of FIG. 7.
Figure 11:
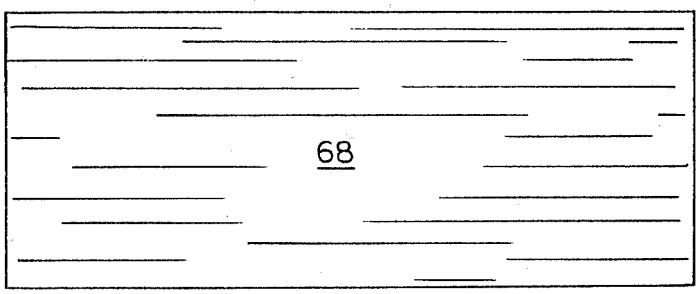
FIG. 11 is a top plan view of the cover member of the keyboard enclosure assembly of FIG. 1.
Figure 12:
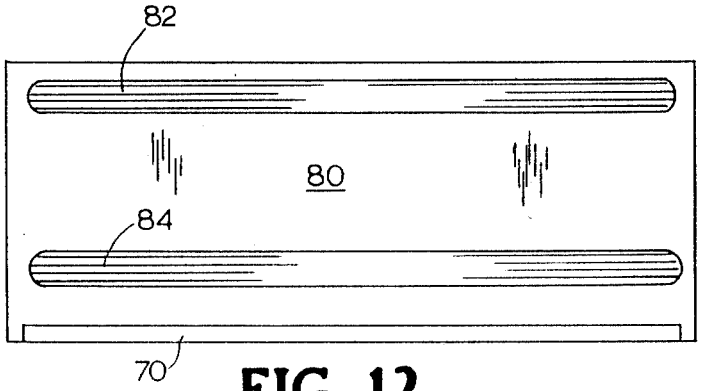
FIG. 12 is a bottom plan view of the cover member of FIG. 10.
Figure 13:
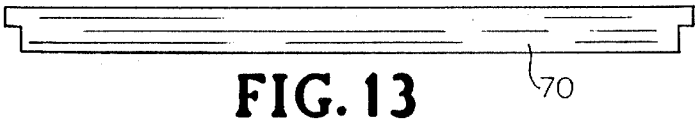
FIG. 13 is a front elevational view of the cover member of FIG. 10.
Figure 14:
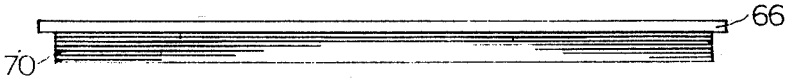
FIG. 14 a rear elevational view of the cover member of FIG. 10.

In the embodiment shown in the drawings, the partial enclosure member is a U-shaped member 20 having a channel 22 along the full length of its inner surface, as best shown in the bottom plan view of this member in FIG. 8. The channel is defined by the spatial volume between the main U-shaped top wall 24, and the respective back wall 26, side walls 28 and 30, and front walls 32 and 34, downwardly depending therefrom. The rear wall 26 features a plug opening 36 therein to accommodate the keyboard connector cable coupling 38 (see FIG. 15), to which is joined the connector cable 40 whose opposite end (not shown) is plugged into the CPU unit of the personal computer system (also not shown for clarity).

The U-shaped member overlies the keyboard so that the channel 22 receives and encloses the keyboard 10 along the rear margin 42 and side margins 44 and 46 of the keyboard. Concurrently, the front walls of the U-shaped member, walls 32 and 34, cover the corresponding extremities 48 and 50 of the front surface 52 of the keyboard.

Thus, when positioned on the keyboard, the side walls of the U-shaped member cover the respective side surfaces 54 and 56 (see FIG. 15) of the keyboard. The rear wall 26 of the U-shaped member covers the rear surface 58 of the keyboard (see FIG. 15). The U-shaped top wall 24 covers the margins 42, 44 and 46 of the main top surface 12 of the keyboard.

The U-shaped member may feature beveling surfaces 60 and 62 on the legs of the U-shaped top wall, and may optionally be similarly beveled across the forward edge 64 of the base of top wall 24.

The cover member 66 as shown in FIG. 1 and FIGS. 11–15 comprises a main top portion 68 which may be of planar configuration as shown or alternatively may be of any other suitable surface configuration, as necessary or desirable in the specific use application. This cover member may be of substantially rectangular shape, as shown, of a size which is generally coextensive with the areal extent of the portion of the main top surface 12 of the keyboard on which the array of keys is disposed, i.e., the main top surface portion which is not covered by the U-shaped member when the same is mounted on the keyboard.

The cover member 66 has joined to the front edge of the main top portion 68 a flange portion 70 depending downwardly therefrom. The flange portion may be integrally formed with the main top portion of the cover member, or they may be separate pieces which are joined to one another to form the cover member as illustrated, by any suitable joining means, such as for example mechanical fasteners, glues, adhesives, bonding media, or the like.

The flange portion may be of a generally shorter linear extent than the main top portion 68, whereby the cover member when reposed in position (as shown in FIG. 5) closely mates with the U-shaped member. Thus, the end surfaces 72 and 74 abut the corresponding facing surfaces 76 and 78 of the front walls 32 and 34 of the U-shaped member, respectively. As a result, there is formed a smooth frontal cover surface, as shown in FIG. 5.

The main top portion 68 of the cover member 66 has on its bottom surface 80 (see FIG. 12) longitudinally extending, laterally spaced-apart recesses 82 and 84. These recesses are positioned and configured to receive and closely overfit the corresponding rows of raised keys 16 and 18, as shown in FIG. 1, so that the cover member is retained in a substantially spatially fixed position on the main top surface 12 of the keyboard. In such manner the cover member flange portion 70 covers the keyboard along its front surface 52, and the main top portion 68 of the cover member covers the keyboard over its main top surface 12, on the surface portion thereof containing the array of keys.

Thus, when the cover member is positioned on the keyboard, the rear row of raised keys 16 is received within the grooved recess 82, while the frontal row of raised keys 18 is received within the grooved recess 84. FIG. 15 shows the inter-relationship between the keyboard and the cover member, with the U-shaped member being deleted in this view for clarity.

The resultingly formed enclosure assembly is shown in FIGS. 2–6 as assembled, and represents a compact configuration which encloses the keyboard over its front, rear, side, and main top surfaces, so that the keyboard is protected from environmental contaminants, e.g., dust, atmospheric moisture, liquid spills from beverage containers, etc., which might otherwise adversely effect the keyboard. Further, the enclosure assembly may be formed of a suitable structural material which is complementary to its environmental surroundings, such as a wood construction which imparts a high aesthetic quality to the enclosure assembly and gives it the appearance of a furniture element.

Although the invention has been shown with specific reference to an enclosure assembly comprising a U-shaped member and complementarily mating cover member, it will be apparent that the specific arrangement of component parts may be varied whereby a cover member having recess(es) on its bottom surface is cooperatively mated or assembled with another member or members covering the keyboard margins and peripheral surfaces. For example, the cover member may be associated with a base member which fully surrounds the margins and peripheral surfaces of the keyboard, e.g., in the form of an open-bottomed box which has a central opening in its horizontal top wall through which the key elements of the keyboard protrude sufficiently to permit at least some of the raised keys to be received within grooves in the cover member.

Further, while the invention has been shown with specific reference to keyboards having key arrays including keys of greater height than others in the array, it will be appreciated that the cover member may be adapted to key arrays in which all keys are of the same height, by providing recesses for all keys in the array, by suitable grooves, or multiple discrete depressions in the cover member bottom surface.

It will be appreciated that the specific embodiment shown and described herein in connection with the drawings permits the cover member to be removed while retaining the U-shaped member in place, so that the keyboard is capable of being used in a normal fashion while the U-shaped member is in position on the keyboard. Accordingly, even in use, the keyboard as associated with such U-shaped member has a significant aesthetic character when the U-shaped member is formed of a selected material of construction having a suitable pleasing appearance.

While the invention has been shown and described with reference to specific embodiments, it will be appreciated that numerous other variations, modifications, and embodiments are possible, and all such variations, modifications and embodiments are to be regarded as being within the spirit and scope of the invention as claimed.

What is claimed is:

1. An enclosed keyboard, including (i) a keyboard having a main top surface comprising an array of keys thereon extending upwardly from the main top surface, with upper portions of said keys being above the main top surface, and with the main top surface being surrounded by side and rear margins and a frontal surface of the keyboard, and (ii) an enclosure assembly for said keyboard, the enclosure assembly comprising a U-shaped member resting on the side and rear margins of the keyboard below said upper portions of said keys and with an upper surface adjacent to said upper portions of said keys, and a cover member comprising a main top portion joined at its front edge to a front flange portion downwardly depending therefrom, the cover member being cooperatively matable with the U-shaped member, with the upper surface of said U-shaped member providing support for side edges of said cover member, with the cover member front flange portion covering the keyboard along said frontal surface thereof, and with the main top portion of the cover member covering the array of keys, said cover member having a bottom surface with at least one recess therein positioned and configured to receive and closely overfit at least some of the keys in the array of keys, to retain the cover member in a substantially spatially fixed position with the cover member overlying the keys and with the cover member and the U-shaped member together enclosing the keyboard over its top and peripheral surfaces.

2. An enclosed keyboard according to claim 1, wherein the array of keys includes selected raised keys of greater height than other keys in said array.

3. An enclosed keyboard according to claim 1, wherein the U-shaped member and cover member are each formed of wood.

4. An enclosure assembly, comprising:

(a) a U-shaped member, comprising a main U-shaped top wall, with side leg portions joined to a rear base portion, from which downwardly depend (i) a back wall, extending along a rear edge of the base portion of the top wall, (ii) side walls, extending along outermost side edges of the leg portions of the top wall, and (iii) front walls, extending along front edges of the leg portions of the top wall; and (b) a cover member comprising a main top portion joined at a front edge thereof to a front flange portion downwardly depending therefrom, the cover member being cooperatively matable with the U-shaped member, with an upper surface of said U-shaped top wall providing support for side portions of said cover member, with a bottom surface of said cover member at said side portions thereof being reposable on said upper surface of said U-shaped top wall, and with said front flange portion of said cover member being of a length equal to the spacing between said front walls of said U-shaped member, and flushly positionable with respect to said front walls when said cover member is cooperatively mated with said U-shaped member.

5. An enclosure assembly according to claim 4, wherein said U-shaped member and cover are each formed of wood.

6. An enclosure assembly according to claim 4, wherein said main top portion of said cover member has a lower surface with at least one recess therein.

* * * * *